US009573369B2

(12) United States Patent
Rivas et al.

(10) Patent No.: US 9,573,369 B2
(45) Date of Patent: Feb. 21, 2017

(54) FLUID EJECTION ASSEMBLY WITH CONTROLLED ADHESIVE BOND

(71) Applicant: Hewlett-Packard Development Company, L.P., Houston, TX (US)

(72) Inventors: Rio Rivas, Corvallis, OR (US); Ed Friesen, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/418,433

(22) PCT Filed: Sep. 19, 2012

(86) PCT No.: PCT/US2012/056115

§ 371 (c)(1),
(2) Date: Jan. 29, 2015

(87) PCT Pub. No.: WO2014/046652

PCT Pub. Date: Mar. 27, 2014

(65) Prior Publication Data

US 2015/0210076 A1 Jul. 30, 2015

(51) Int. Cl.
*B41J 2/16* (2006.01)
*B41J 2/14* (2006.01)

(52) U.S. Cl.
CPC ..... *B41J 2/14201* (2013.01); *B41J 2/14145* (2013.01); *B41J 2/1603* (2013.01); *B41J 2/1607* (2013.01); *B41J 2/1623* (2013.01); *B41J 2002/14362* (2013.01); *B41J 2002/14387* (2013.01)

(58) Field of Classification Search
CPC ..... B41J 2/1631; B41J 2/1632; B41J 2/14137; B41J 2/1623; B41J 2/1607; B41J 2/1603; B41J 2/4145; B41J 2002/14362; B41J 2002/14387
USPC ..... 347/44, 47; 29/890.1
See application file for complete search history.

(56) References Cited

U.S. PATENT DOCUMENTS 5,563,643 A 10/1996 Carlotta
5,872,583 A 2/1999 Yamamoto
5,969,739 A 10/1999 Altendorf
(Continued)

FOREIGN PATENT DOCUMENTS

CN 101204878 A 6/2008
EP 0507134 A2 10/1992
(Continued)

OTHER PUBLICATIONS

International Search Report for PCT/US2012/056115 dated Jan. 21, 2013.

(Continued)

*Primary Examiner* — Julian Huffman
*Assistant Examiner* — Sharon A Polk
(74) *Attorney, Agent, or Firm* — HP Inc Patent Department

(57) ABSTRACT

In an embodiment, a fluid ejection device includes a die including a fluid feed slot that extends from a back side to a front side of the die, a firing chamber formed on the front side to receive fluid from the feed slot, a fluid distribution manifold adhered to the back side to provide fluid to the feed slot, and a corrosion-resistant layer coating the back side of the die so as not to extend into the feed slot.

19 Claims, 4 Drawing Sheets

(56) References Cited

U.S. PATENT DOCUMENTS

| | | | | |
|---|---|---|---|---|
| 7,372,145 | B2 | 5/2008 | Silverbrook | |
| 2004/0165028 | A1 | 8/2004 | Ito et al. | |
| 2005/0036004 | A1* | 2/2005 | Horn | B41J 2/1603 347/65 |
| 2007/0046730 | A1* | 3/2007 | Min | B41J 2/14137 347/61 |
| 2007/0242101 | A1 | 10/2007 | Hirosawa et al. | |
| 2008/0165222 | A1 | 7/2008 | Hayakawa | |
| 2009/0096845 | A1 | 4/2009 | Braun et al. | |
| 2009/0179965 | A1* | 7/2009 | Hirosawa | B41J 2/14024 347/50 |
| 2009/0295870 | A1 | 12/2009 | Goin | |
| 2009/0309938 | A1* | 12/2009 | Yoneda | B41J 2/1603 347/85 |
| 2011/0102509 | A1* | 5/2011 | Sharan | B41J 2/14 347/47 |

FOREIGN PATENT DOCUMENTS

| | | |
|---|---|---|
| EP | 1518681 | 3/2005 |
| JP | 05338177 | 12/1993 |
| JP | 2001047620 | 2/2001 |
| JP | 2007062251 | 3/2007 |
| TW | 200604021 A | 2/2006 |

OTHER PUBLICATIONS

Murata, et al High Resolution Long Array Thermal Ink Jet Printing with On-Chip LSI Heater Plate and Mioromachined Si Channel Plate. p. 1792-1800. vol. 84 Issue 12.

* cited by examiner

FLUID EJECTION ASSEMBLY WITH CONTROLLED ADHESIVE BOND

BACKGROUND

Fluid ejection devices, such as printheads in inkjet printers, provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within an ink ejection chamber. In another example, a piezoelectric inkjet printhead uses a piezoelectric material actuator to generate pressure pulses in an ink ejection chamber that force ink drops out of a nozzle.

Prior to the ejection of ink drops from a nozzle, ink may travel from an ink reservoir to the ink ejection chamber through an ink feed slot that connects the chamber to the ink reservoir. Often, the ink feed slot is formed in a silicon substrate that is bonded to a body of the ink reservoir.

BRIEF DESCRIPTION OF THE DRAWINGS

The present embodiments will now be described, by way of example, with reference to the accompanying drawings, in which.

DETAILED DESCRIPTION

Overview

Figure 1:
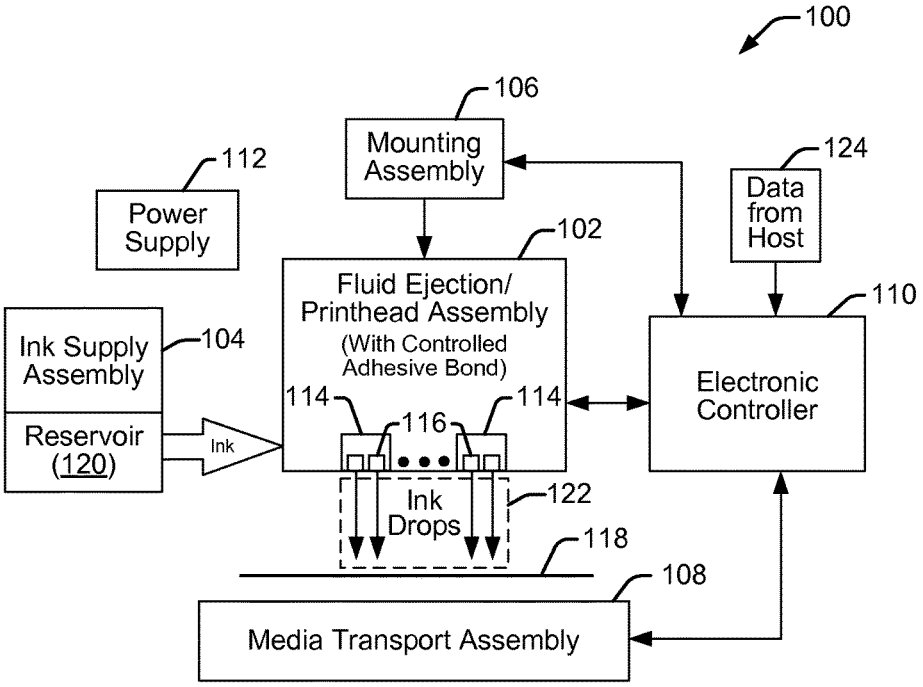
FIG. 1 illustrates an inkjet printing system 100 suitable for incorporating a fluid ejection assembly with a controlled adhesive bond as disclosed herein, according to an embodiment.

As noted above, inkjet printheads often have at least one ink feed slot formed in a silicon substrate that provides fluid communication between an ink ejection chamber and an ink reservoir. The substrate is disposed between the ink ejection chamber and the ink reservoir body, or substrate carrier, and is adhered to the substrate carrier such that ink feed slots in the substrate correspond with fluid pathways in the carrier. Because the width of the ink feed slots can be on the micron scale, small obstructions may adversely affect the ink flow from the ink reservoir to the ink chamber. Such obstructions can also trap air or other gases within the ink chamber, resulting in an inadequate ink supply to the printhead nozzles. Air in the ink chamber can be generated during the ink ejection process in a number of ways. For example, the heating of ink can lead to the formation of air bubbles because heated fluid has a lower solubility for dissolved air. In addition, bubbles can form in an ink chamber either from ejecting an ink drop or from ingesting an air bubble during refill of the chamber.

A printhead can be designed with a passive air management system that buoyantly conveys the air bubbles away from the ink ejection chamber, through the ink feed slot, and into a safe air storage location within the body of the ink reservoir (i.e., substrate carrier). In general, such a system comprises increasingly wider fluid pathways that extend from the ink ejection chamber to the safe air storage location. Thus, the geometric shapes and relative cross-sectional widths of the ink feed slots and fluid passageways help to manage air bubbles in the printhead. However, small obstructions in the ink feed slot and/or fluid pathways of the substrate carrier can trap the air bubbles, impeding their natural buoyant conveyance. One common obstruction often found in an ink feed slot is the adhesive employed to bond the substrate to the carrier. An ongoing challenge with the fabrication of printheads is an adhesive "squish" or "bulge" into the ink feed channel that can occur when the printhead die/substrate is attached to the substrate carrier. If the adhesive bulges far enough into the width of the ink feed slot, it can obstruct the ink flow and inhibit the passive air management of the printhead, eventually leading to nozzle starvation and print defects.

Embodiments of the present disclosure provide a fluid ejection device and fabrication methods that enable a controlled adhesive bond between a substrate and a substrate carrier (i.e., the ink reservoir body). The controlled adhesive bond comprises a concavely tapering adhesive profile that narrows in the middle as the adhesive bond extends away from bonding locations on both the substrate and carrier surfaces. Adhesive contact footprints formed at the adhesive bonding locations on the substrate and carrier surfaces have widths that do not exceed, respectively, the widths of the substrate and carrier bonding surfaces themselves. Thus, the width of the adhesive bond at any point of the bond, does not exceed the width of either the substrate bonding surface or the carrier bonding surface. The adhesive bond profile, controlled in this manner, eliminates any bulging out at the middle area of the adhesive bond into the ink feed slots. In addition, the controlled adhesive bond profile eliminates any protrusion of the adhesive bond into the ink feed slots from the adhesive contact footprints at both the substrate bonding surface and the carrier bonding surface. Accordingly, the controlled adhesive bond profile eliminates adhesive bond obstructions in the ink feed slots and facilitates the passive air management within the printhead.

Methods of achieving the controlled adhesive bond profile comprise making the adhesive-to-substrate contact angles, and adhesive-to-carrier contact angles, hydrophilic. That is, the contact angles of the adhesive to both the substrate and carrier surfaces are made to be less than 90 degrees. The desired hydrophilic contact angles can be achieved by controlling the adhesive formulation, the substrate surface, and the carrier surface.

In one embodiment, a fluid ejection assembly includes a substrate with substrate ribs that define an ink feed slot extending from a top side to a bottom side of the substrate. The assembly further includes a substrate carrier having carrier ribs that define a fluid passageway to provide ink to the ink feed slot. The assembly also includes a concavely tapered adhesive bond to adhere a substrate rib surface to a carrier rib surface without protruding into the ink feed slot or the fluid passageway.

In another embodiment, a fluid ejection assembly includes a printhead bonded to a fluid distribution manifold. The bond forms a fluid pathway extending from a fluid chamber on the printhead through the manifold. The assembly also includes a concavely tapered adhesive bond between the printhead and the manifold that does not protrude into the fluid pathway.

In another embodiment, a method of fabricating a controlled adhesive bond in a fluid ejection assembly includes fabricating a printhead substrate comprising substrate ribs defining ink feed slots. The method further includes fabricating a substrate carrier comprising carrier ribs defining fluid passageways. The method also includes depositing an adhesive on bonding surfaces of the carrier ribs, and bringing the substrate ribs into proximity with respective carrier ribs such that the deposited adhesive contacts bonding surfaces of the substrate ribs. The method includes forming hydrophilic contact angles of less than 90 degrees where the adhesive contacts the bonding surfaces. The hydrophilic contact angles are formed such that the adhesive forms a concavely tapered adhesive bond profile that does not protrude into the ink feed slots or fluid passageways.

Illustrative Embodiments

FIG. 1 illustrates an inkjet printing system 100 suitable for incorporating a fluid ejection assembly with a controlled adhesive bond as disclosed herein, according to an embodiment. In this embodiment, the fluid ejection assembly is implemented with a fluid drop jetting printhead 114 bonded to a substrate carrier with a controlled adhesive bond. Inkjet printing system 100 includes a fluid ejection assembly implemented as an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one fluid ejection device 114 or printhead 114 with a controlled adhesive bond, that ejects drops of ink through a plurality of orifices or nozzles 116 toward a print medium 118 so as to print onto print medium 118. Print medium 118 comprises any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed onto print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

Figure 2:
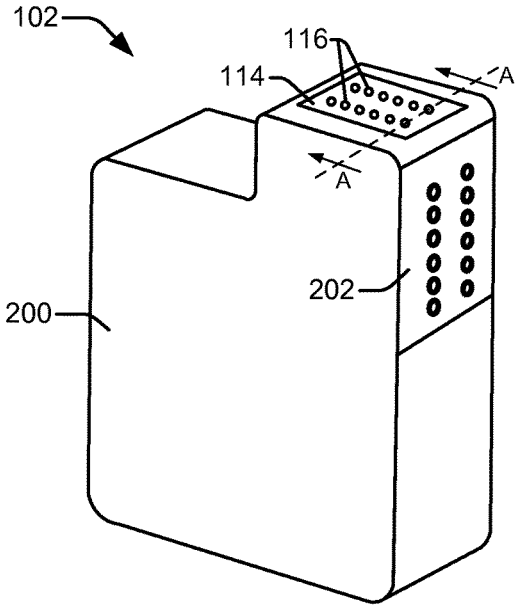
FIG. 2 shows an example of an inkjet printhead assembly implemented as an inkjet cartridge/pen, according to an embodiment.

In one example implementation, inkjet printhead assembly 102 and ink supply assembly 104 are housed together in an inkjet cartridge or pen. FIG. 2 shows an example of an inkjet printhead assembly 102 implemented as an inkjet cartridge/pen 102, according to an embodiment. The inkjet cartridge/pen 102 includes a body 200, a printhead 114 (i.e., fluid ejection device), and electrical contacts 202. Individual ejection elements (e.g., thermal resistors, piezo membranes) within the printhead 114 are energized by electrical signals provided at contacts 202 to eject droplets of fluid ink from selected nozzles 116. The fluid can be any suitable fluid used in a printing process, such as various printable fluids, inks, pre-treatment compositions, fixers, and the like. In some examples, the fluid can be a fluid other than a printing fluid. The inkjet cartridge 102 may contain its own fluid supply within the cartridge body 200, or it may receive fluid from an external supply such as a fluid reservoir 120 connected to the cartridge 102 through a tube, for example. In either case, as discussed below, a printhead assembly 102 such as an inkjet cartridge 102 comprises a printhead substrate bonded to a substrate carrier that comprises a fluid distribution manifold with fluid pathways providing fluid communication between the printhead and the fluid reservoir. Inkjet cartridges 102 containing their own fluid supplies are generally disposable once the fluid supply is depleted.

Referring again to FIG. 1, mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printhead assembly 102 is a scanning type printhead assembly. In a scanning type printhead assembly, mounting assembly 106 includes a carriage for moving inkjet printhead assembly 102 relative to media transport assembly 108 to scan print medium 118. In another embodiment, inkjet printhead assembly 102 is a non-scanning type printhead assembly. In a non-scanning printhead assembly, mounting assembly 106 fixes inkjet printhead assembly 102 at a prescribed position relative to media transport assembly 108. Thus, media transport assembly 108 positions print medium 118 relative to inkjet printhead assembly 102.

Electronic controller 110 typically includes a processor, firmware, and other printer electronics for communicating with and controlling inkjet printhead assembly 102, mounting assembly 106, and media transport assembly 108. Electronic controller 110 receives data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example implementation, electronic controller 110 controls inkjet printhead assembly 102 for ejection of ink drops from nozzles 116. Thus, controller 110 defines a pattern of ejected ink drops that form characters, symbols, and/or other graphics or images on print medium 118. The pattern of ejected ink drops is determined by the print job commands and/or command parameters from data 124.

In one implementation, inkjet printhead assembly 102 includes one fluid ejection device/printhead 114. In another implementation, inkjet printhead assembly 102 is a wide-array or multi-head printhead assembly. In one example of a wide-array printhead assembly, the inkjet printhead assembly 102 includes a conveyance such as a print bar that carries multiple printheads 114, provides electrical communication between the printheads 114 and electronic controller 110, and provides fluidic communication between the printheads 114 and the ink supply assembly 104.

In one example implementation, inkjet printing system 100 is a drop-on-demand thermal bubble inkjet printing system where the fluid ejection device 114 is a thermal inkjet (TIJ) fluid ejection device/printhead 114. The TIJ printhead 114 implements a thermal resistor heating element as an ejection element in an ink chamber to vaporize ink and create bubbles that force ink or other fluid drops out of a nozzle 116. In another example implementation, inkjet printing system 100 is a drop-on-demand piezo inkjet printing system where the fluid ejection device 114 is a piezoelectric inkjet printhead that employs a piezoelectric material actuator to generate pressure pulses to force ink drops out of nozzles 116.

Figure 3:
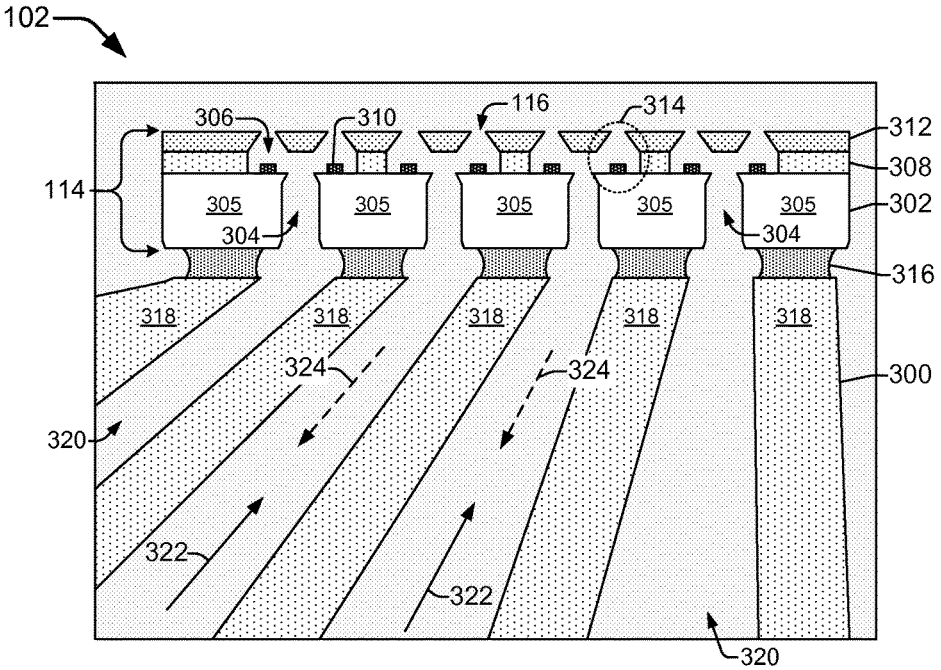
FIG. 3 shows a cross-sectional view of a portion of a fluid ejection/printhead assembly, according to an embodiment.

FIG. 3 shows a cross-sectional view of a portion of a fluid ejection/printhead assembly 102, taken along the line A-A of FIG. 2. Printhead assembly 102 generally includes a printhead 114 bonded to a fluid distribution manifold 300. The fluid distribution manifold 300 is sometimes referred to as a chiclet or a printhead substrate carrier, but in this description it will primarily be referred to as a substrate carrier 300. Printhead 114 includes a printhead substrate 302 comprising a silicon die. Elongated ink feed slots 304 are formed between substrate ribs 305 of the substrate 302. The elongated ink feed slots 304 extend into the plane of FIG. 3. The ink feed slots 304 are in fluid communication at the top side of the substrate 302 with fluid/ink chambers 306 formed in a fluidics or chamber layer 308 disposed on the top side of the substrate 302. Each fluid/ink chamber 306 comprises a thermal resistor heating element 310 that acts as an ejection element within the respective chamber 306 to vaporize ink or other fluids, creating bubbles that force fluid drops out of a corresponding nozzle 116. Resistor 310 can be formed within a thin film stack applied on the top side of substrate 302. A thin film stack generally includes a metal layer forming the resistor 310 (e.g., tantalum-aluminum (TaAl), tungsten silicon-nitride (WSiN)), a passivation layer (e.g., silicon carbide (SiC) and silicon nitride (SiN)), and a cavitation layer (e.g., tantalum (Ta)). A top hat layer 312, also referred to as the orifice plate or nozzle layer 312, is disposed on top of the chamber layer 308 and has nozzles 116 formed therein that each correspond with a respective chamber 306 and resistor 310. Thus, individual fluid drop generators 314 are formed by corresponding chambers 306, resistors 310, and nozzles 116. The chamber layer 308 and nozzle layer 312 can be formed, for example, of a polymeric material such as SU8 commonly used in the fabrication of microfluidics and MEMS devices. In one implementation, the nozzle layer 312 and chamber layer 308 are formed together such that they comprise a single structure.

Printhead substrate 302 is bonded at the surface of its bottom side to the underlying substrate carrier 300 (i.e., fluid distribution manifold) by an adhesive bond 316. More specifically, in one implementation each substrate rib 305 is bonded to a corresponding carrier rib 318 of substrate carrier 300. The ink feed slots 304 are in fluid communication at the bottom side of the substrate 302 with the fluid passageways 320 formed by carrier ribs 318 of substrate carrier 300. Thus, the ink feed slots 304 provide fluid communication between the fluid/ink chambers 306 on the top side of substrate 302 and the fluid passageways 320 at the bottom side of substrate 302. The variously slanted fluid passageways 320 in the substrate carrier 300, in turn, provide fluid communication with a fluid/ink reservoir such as reservoir 120 (FIG. 1). The fluid passageways 320 and ink feed slots 304 together, conduct fluid/ink from a reservoir 120 toward the fluid/ink chambers 306 where it can be ejected through nozzles 116, as generally indicated by solid direction arrows 322. Additionally, the physical orientation of the printhead assembly 102 during its use is with the substrate carrier 300 situated above the substrate 302 (i.e., with nozzles 116 facing downward toward print media), which enables the buoyant conveyance of air bubbles away from chambers 306 in a manner indicated by the dashed direction arrows 324. Thus, the printhead assembly 102 provides a passive air management system in which air bubbles travel away from chambers 306 through the ink feed slots 304 and fluid passageways 320.

The adhesive bond 316 facilitates the buoyant conveyance of air bubbles away from the fluid/ink chambers 306 by its recessed profile. The adhesive bond 316 is controlled such that its profile does not protrude into the ink feed slots 304 and fluid passageways 320, and therefore does not hinder the conveyance of air bubbles away from chambers 306. By contrast, prior adhesive bonds are generally not controlled and hinder the conveyance of air bubbles away from chambers 306 because they protrude and/or bulge out to some extent into the ink feed slots 304 and fluid passageways 320.

Figure 4:
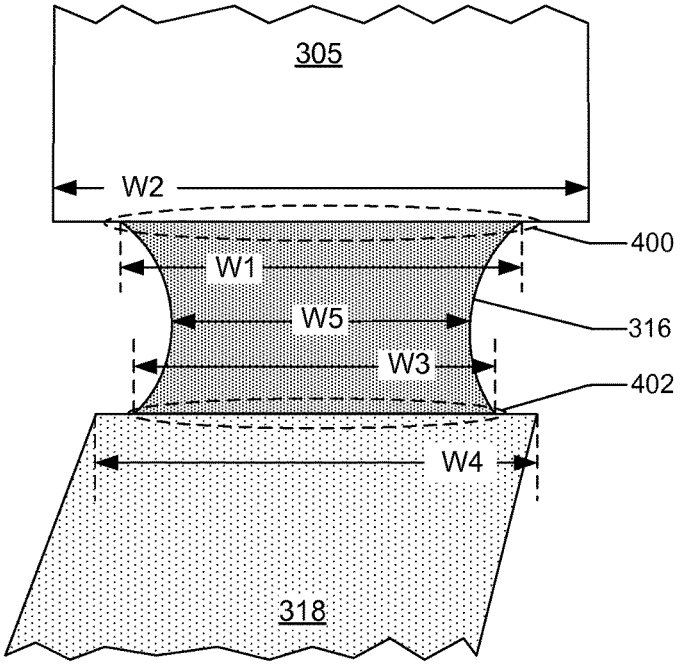
FIG. 4 shows an enlarged cross-sectional view of one adhesive bond that bonds a substrate rib with a carrier rib, according to an embodiment.

FIG. 4 shows an enlarged cross-sectional view of one adhesive bond 316 that bonds a substrate rib 305 with a carrier rib 318, according to an embodiment. It is noted that the contours of the adhesive bond profile, as well as the relative widths of the adhesive bond profile to one another and to the widths of the substrate rib 305 and carrier rib 318, are not to scale and may be exaggerated for the purpose of illustration. The controlled adhesive bond 316 comprises a profile that tapers away from the adhesive contact points (400, 402) in a concave manner. Thus, the concavely tapering adhesive bond profile narrows toward the mid-section of the adhesive bond 316 as the bond extends away from both its substrate contact point 400 and its carrier contact point 402. Each adhesive contact point (400, 402) forms an "adhesive footprint" having an associated width. As shown in FIG. 4, in one implementation the width, W1, of the substrate adhesive footprint/contact 400, is less than or does not exceed the width, W2, of the bonding surface of the substrate rib 305. Also shown in FIG. 4, in one implementation the width, W3, of the carrier adhesive footprint/contact 402, is less than or does not exceed the width, W4, of the bonding surface of the carrier rib 318. In one implementation, the width, W5, of the mid-section of the adhesive bond 316 does not exceed either of the widths, W1 or W3, of the adhesive footprints/contacts (400, 402). Thus, the controlled adhesive bond 316 does not bulge or protrude out into the ink feed slots 304 and fluid passageways 320 at its mid-section, its adhesive footprints/contacts (400, 402), or at any other point of its concavely tapered profile.

Figure 5:
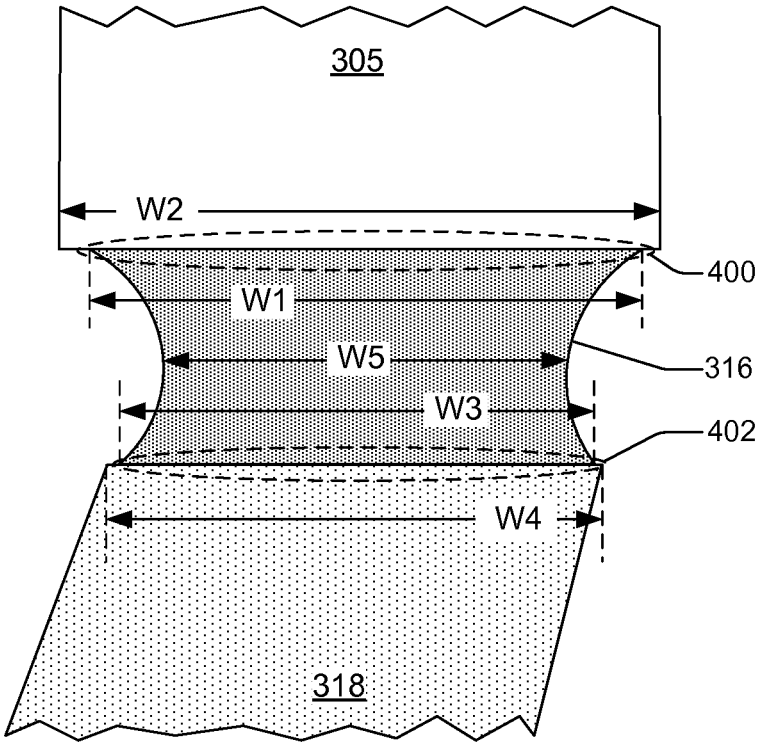
FIG. 5 shows an enlarged cross-sectional view of another adhesive bond that bonds a substrate rib with a carrier rib, according to an embodiment.

FIG. 5 shows an enlarged cross-sectional view of another adhesive bond 316 that bonds a substrate rib 305 with a carrier rib 318, according to an embodiment. As in the FIG. 4 example, the controlled adhesive bond 316 shown in FIG. 5 comprises a profile that tapers away from the adhesive contact points (400, 402) in a concave manner such that the adhesive bond profile narrows toward the mid-section of the adhesive bond 316 as the bond extends away from both its substrate contact point 400 and its carrier contact point 402. As shown in FIG. 5, in one implementation, while the width, W1, of the substrate adhesive footprint/contact 400 does not exceed the width, W2, of the bonding surface of the substrate rib 305 (i.e., as discussed above regarding FIG. 4), in some cases the width, W1, can exceed the width of the bonding surface of the carrier rib 318. In general, while the width of an adhesive footprint/contact (400, 402) does not exceed the width of the surface to which it is bonded, it may exceed the width of the surface to which the opposite adhesive footprint/contact (400, 402) is bonded. This may in part, depend at least upon the relative widths of the bonding surfaces available on the substrate rib 305 and the carrier rib 318. In any case, as noted above with regard to FIG. 4, the controlled adhesive bond 316 does not bulge or protrude out into the ink feed slots 304 and fluid passageways 320 at its mid-section, its adhesive footprints/contacts (400, 402), or at any other point of its concavely tapered profile.

Figure 6:
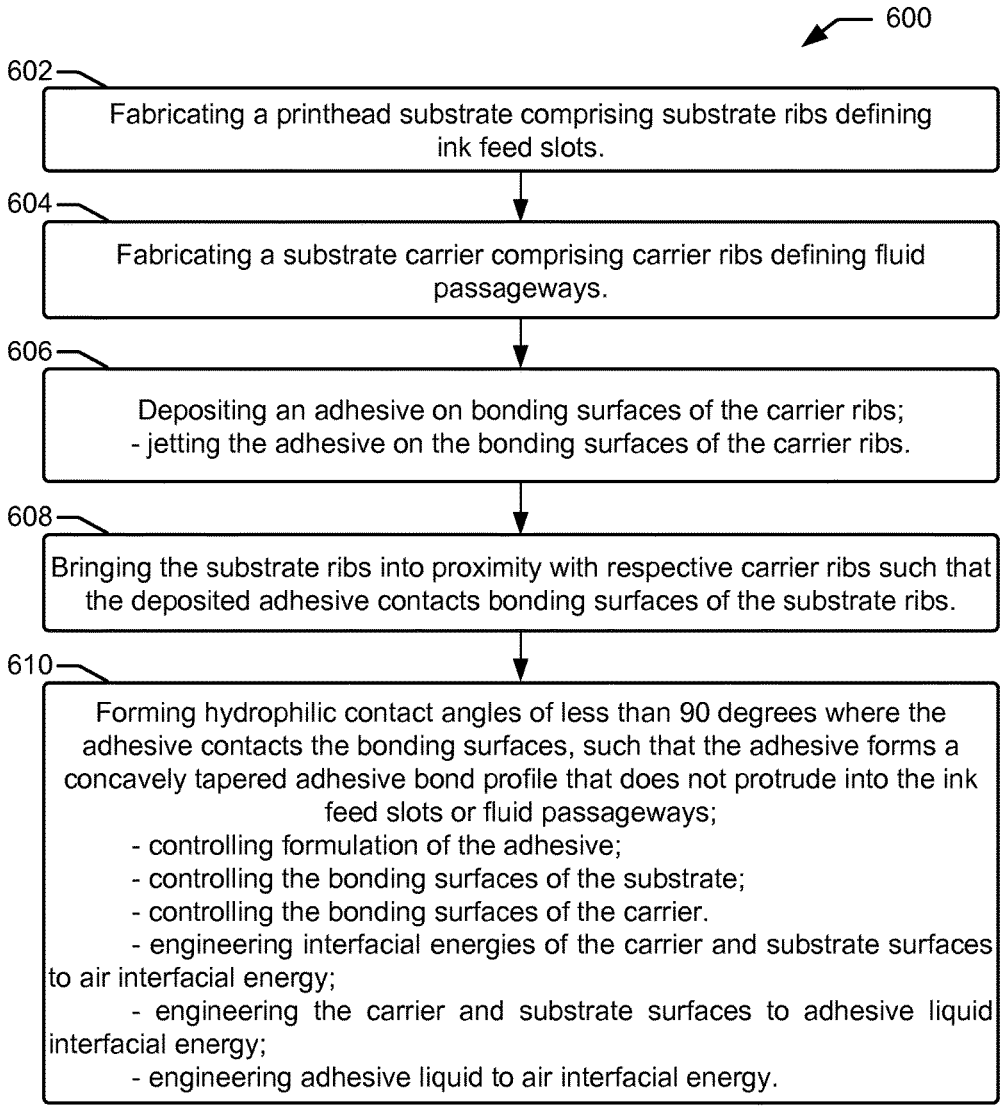
FIG. 6 shows a flowchart of an example method of fabricating a controlled adhesive bond in a fluid ejection/printhead assembly, according to an embodiment.

FIG. 6 shows a flowchart of an example method 600 of fabricating a controlled adhesive bond in a fluid ejection/printhead assembly, according to an embodiment of the disclosure. Method 600 is associated with the embodiments discussed herein with respect to FIGS. 1-5, and details of the steps shown in method 500 may be found in the related discussion of such embodiments. Method 600 may include more than one implementation, and different implementations of method 600 may not employ every step presented in the flowchart. Therefore, while steps of method 600 are presented in a particular order in the flowchart, the order of their presentation is not intended to be a limitation as to the order in which the steps may actually be implemented, or as to whether all of the steps may be implemented. For example, one implementation of method 600 might be achieved through the performance of a number of initial steps, without performing one or more subsequent steps, while another implementation of method 600 might be achieved through the performance of all of the steps.

Method 600 begins at block 602 with fabricating a printhead substrate comprising substrate ribs defining ink feed slots. The printhead substrate is typically fabricated from a silicon or glass wafer through standard microfabrication processes that are well-known to those skilled in the art such as electroforming, laser ablation, anisotropic etching, sputtering, dry etching, photolithography, casting, molding, stamping, and machining. The printhead substrate may also be further developed to include a fluidics and nozzle layer on a top side of the substrate. The method 600 continues at block 604 with fabricating a substrate carrier comprising carrier ribs defining fluid passageways. The substrate carrier is a fluid distribution manifold such as a plastic fluidic interposer, or chiclet. At block 606 of method 600, an adhesive is deposited on bonding surfaces of the carrier ribs. Alternatively, or in addition, the adhesive can be deposited onto bonding surfaces of the substrate ribs. In one implementation, the deposition of the adhesive occurs by jetting the adhesive. Jetting the adhesive, rather than using another method such as needle deposition, provides advantages such as the ability to precisely control both the volume of the adhesive and the precise location of the adhesive on the bonding surfaces.

The method 600 continues at block 608, with bringing the substrate ribs into proximity with respective carrier ribs such that the deposited adhesive contacts both the substrate rib bonding surfaces and respective carrier rib bonding surfaces. Thus, a single volume of adhesive is disposed between each of the substrate rib and carrier rib surfaces. At block 610, the method 600 includes forming hydrophilic contact angles of less than 90 degrees in the adhesive where it contacts the bonding surfaces of the substrate ribs and carrier ribs, such that the adhesive bond forms a concavely tapered profile between each substrate rib and carrier rib. As is known to those skilled in the art of theoretical wetting and contact angle science, following Young's equation, hydrophilic contact angles are achieved by engineering the interfacial energies of the carrier and substrate surfaces to air interfacial energy, the carrier and substrate surfaces to adhesive liquid interfacial energy, and the adhesive liquid to air interfacial energy. The bonding surface roughness will also inform the contact angle as per Wenzel's equation. Thus, the hydrophilic contact angles are achieved in various ways including, by controlling the adhesive formulation, and controlling the bonding surfaces of the substrate and carrier. For example, for epoxy adhesives, the liquid adhesive surface energy is controlled by the selection and proportions of the resin and activator chemical compounds in the adhesive. Additionally, the surface energy can modified with additives to the adhesive. The carrier surface energy is controlled by the selection of molded plastic and the roughness of the carrier surface. Additionally, the carrier surface may be coated to change the surface energy. The substrate surface energy is also controlled by the roughness of the bonding surface of the substrate ribs. The bonding surfaces of the substrate can be the silicon substrate itself, or they can have a thinfilm coating such as silicon oxide, silicon nitride or tantalum.

What is claimed is:

1. A fluid ejection assembly comprising:

a substrate including substrate ribs that define ink feed slots extending from a top side to a bottom side of the substrate, the ink feed slots comprising a first ink feed slot and a second ink feed slot, the substrate ribs comprising a substrate rib having a substrate rib surface;

a substrate carrier including carrier ribs that define fluid passageways, the fluid passageways comprising a first fluid passageway to provide ink to the first ink feed slot and a second fluid passageway to provide ink to the second ink feed slot, the carrier ribs comprising a carrier rib including a carrier rib surface facing the substrate rib surface and having a width W4 extending from an edge of the first fluid passageway to an edge of the second fluid passageway; and a concavely tapered adhesive bond directly contacting the substrate rib surface and the carrier rib surface to adhere the substrate rib surface to the carrier rib surface without protruding into the first ink feed slot, the second ink feed slot, the first fluid passageway or the second fluid passageway, the adhesive bond comprising a mid-section that has a width W5 that does not exceed the width W4 of the carrier rib surface.

2. A fluid ejection assembly as in claim 1, wherein the substrate rib surface has a width W2 extending from an edge of the first ink feed slot to an edge of the second ink feed slot, the fluid ejection assembly further comprising: a substrate adhesive footprint defining a contact point of the adhesive bond at the substrate rib surface; wherein a width W1 of the substrate adhesive footprint does not exceed the width W2 of the substrate rib surface.

3. A fluid ejection assembly as in claim 2, wherein the width W5 does not exceed the width W1 of the substrate adhesive footprint.

4. A fluid ejection assembly as in claim 1, further comprising: a carrier adhesive footprint defining a contact point of the adhesive bond at the carrier rib surface; wherein a width W3 of the carrier adhesive footprint does not exceed the width W4 of the carrier rib surface.

5. A fluid ejection assembly as in claim 4, wherein the width W5 does not exceed the width W3 of the carrier adhesive footprint.

6. A fluid ejection assembly as in claim 1, wherein the substrate rib surface has a width W2 extending from an edge of the first ink feed slot to an edge of the second ink feed slot, wherein the width W5 does not exceed the width W2 of the substrate rib surface or the width W4 of the carrier rib surface.

7. A fluid ejection assembly as in claim 1, wherein the substrate rib surface has a width W2 extending from an edge of the first ink feed slot to an edge of the second ink feed slot, the fluid ejection assembly further comprising: first and second adhesive footprints defining contact points of the adhesive bond at first and second bonding surfaces, respectively; wherein a width W1 of the first adhesive footprint exceeds the width W4 of the second bonding surface, but does not exceed the width W2 of the substrate rib surface.

8. A fluid ejection assembly as in claim 1, wherein the adhesive bond comprises hydrophilic contact angles of less than 90 degrees at contact points where the adhesive bond contacts the substrate rib surface and the carrier rib surface.

9. A fluid ejection assembly as in claim 1, further comprising a fluid chamber on the top side of the substrate to receive ink from the ink feed slot.

10. A fluid ejection assembly as in claim 1, further comprising:

a carrier adhesive footprint defining a contact point of the adhesive bond at the carrier rib surface having a width W3;

wherein the width W3 of the carrier adhesive footprint exceeds the width W5 of the adhesive bond mid-section.

11. A fluid ejection assembly as in claim 1, further comprising:

a substrate adhesive footprint defining a contact point of the adhesive bond at the substrate rib surface having a width W1, wherein the width W1 of the substrate adhesive footprint does not exceed the width W5 of the adhesive bond mid-section.

12. A fluid ejection assembly comprising:

a printhead bonded to a fluid distribution manifold to form a fluid pathway extending from a fluid chamber on the printhead through the manifold; and a concavely tapered adhesive bond between the printhead and the manifold that does not protrude into the fluid pathway, wherein the adhesive bond comprises hydrophilic contact angles of less than 90° at contact points where the adhesive bond contacts the print head and the manifold.

13. A fluid ejection assembly as in claim 12, further comprising:

a substrate adhesive footprint defining a contact point of the adhesive bond at the printhead and having a substrate adhesive footprint with;

a carrier adhesive footprint defining a contact point of the adhesive bond at the manifold and having a carrier adhesive footprint with, wherein the adhesive bond comprises a mid-section that has a midsection width, and wherein the mid-section width of the adhesive bond is less than the substrate adhesive footprint with, and the mid-section width of the adhesive bond is less than the carrier adhesive footprint width.

14. A fluid ejection assembly as in claim 12, further comprising: a nozzle corresponding with the fluid chamber; and a resistor to heat fluid in the fluid chamber and eject fluid through the nozzle.

15. A method of fabricating a controlled adhesive bond in a fluid ejection assembly, comprising:

fabricating a printhead substrate comprising substrate ribs defining ink feed slots;

fabricating a substrate carrier comprising carrier ribs defining fluid passageways;

depositing an adhesive on bonding surfaces of the carrier ribs;

bringing the substrate ribs into proximity with respective carrier ribs such that the deposited adhesive contacts bonding surfaces of the substrate ribs;

forming hydrophilic contact angles of less than 90 degrees where the adhesive contacts the bonding surfaces, such that the adhesive forms a concavely tapered adhesive bond profile that does not protrude into the ink feed slots or fluid passageways, wherein the adhesive bond profile comprises a midsection having a width W5 that does not exceed a width W4 of a carrier rib surface of an adjacent one of the carrier ribs.

16. A method as in claim 15, wherein depositing an adhesive on bonding surfaces of the carrier ribs comprises jetting the adhesive on the bonding surfaces of the carrier ribs.

17. A method as in claim 15, wherein forming hydrophilic contact angles comprises:

controlling formulation of the adhesive;

controlling the bonding surfaces of the substrate; and controlling the bonding surfaces of the carrier.

18. A method as in claim 15, wherein forming hydrophilic contact angles comprises:

engineering interfacial energies of the carrier and substrate surfaces to air interfacial energy;

engineering the carrier and substrate surfaces to adhesive liquid interfacial energy; and engineering adhesive liquid to air interfacial energy.

19. A fluid ejection assembly comprising:

a substrate including substrate ribs that define an ink feed slot extending from a top side to a bottom side of the substrate;

a substrate carrier including carrier ribs that define a fluid passageway to provide ink to the ink feed slot; and a concavely tapered adhesive bond to adhere a substrate rib surface to the a carrier rib surface without protruding into ink feed slot or the fluid passageway, the adhesive bond comprising a mid-section that has a width, W5, that does not exceed a width, W4, of the carrier rib surface, wherein the adhesive bond comprises hydrophilic contact angles of less than 90 degrees at contact points where the adhesive bond contacts the substrate rib surface and the carrier rib surface.

* * * * *